US009279424B2

(12) United States Patent
Petersen et al.

(10) Patent No.: US 9,279,424 B2
(45) Date of Patent: Mar. 8, 2016

(54) VANE CELL MACHINE HAVING PLATES CONTAINING AXIAL MOVING INSERTS BEARING AGAINST THE ROTOR

(71) Applicant: Danfoss A/S, Nordborg (DK)

(72) Inventors: Hans Christian Petersen, Nordborg (DK); Ove Thorboel Hansen, Nordborg (DK); Lars Martensen, Soenderborg (DK); Palle Olsen, Nordborg (DK); Erik Haugaard, Graasten (DK)

(73) Assignee: Danfoss A/S, Nordborg (DK)

( * ) Notice: Subject to any disclaimer, the term of this patent is extended or adjusted under 35 U.S.C. 154(b) by 407 days.

(21) Appl. No.: 13/659,011

(22) Filed: Oct. 24, 2012

(65) Prior Publication Data

US 2013/0108498 A1 May 2, 2013

(30) Foreign Application Priority Data

Oct. 25, 2011 (DE) ..... 10 2011 116 858

(51) Int. Cl.

| | |
|---|---|
| ***F04C 15/00*** | (2006.01) |
| ***F04C 2/344*** | (2006.01) |
| ***F01C 21/10*** | (2006.01) |
| ***F01C 21/08*** | (2006.01) |

(52) U.S. Cl.

CPC ..... *F04C 15/0023* (2013.01); *F01C 21/108* (2013.01); *F04C 2/344* (2013.01); *F01C 21/0809* (2013.01); *F04C 2230/91* (2013.01)

(58) Field of Classification Search

CPC ..... F01C 21/0809; F01C 21/108; F04C 15/0023; F04C 2230/91; F04C 2/344

USPC ..... 418/131, 133, 144, 152, 235, 259–260

See application file for complete search history.

(56) References Cited

U.S. PATENT DOCUMENTS

| | | | | |
|---|---|---|---|---|
| 2,672,282 | A | 3/1954 | Novas | |
| 3,012,511 | A * | 12/1961 | Adams | 418/133 |
| 3,582,241 | A | 6/1971 | Niemiec et al. | |
| 4,088,426 | A | 5/1978 | Edwards | |
| 4,505,654 | A | 3/1985 | Dean, Jr. et al. | |
| 4,772,190 | A * | 9/1988 | Merz et al. | 418/133 |
| 5,266,018 | A | 11/1993 | Niemiec | |
| 5,947,712 | A | 9/1999 | Viegas et al. | |
| 6,053,718 | A | 4/2000 | Schmidt et al. | |
| 6,629,829 | B1 | 10/2003 | Shinoda et al. | |
| 8,951,027 | B2 * | 2/2015 | Petersen et al. | 418/144 |

(Continued)

FOREIGN PATENT DOCUMENTS

| | | | |
|---|---|---|---|
| CN | 101368562 | A | 2/2009 |
| DE | 24 22 783 | A1 | 11/1975 |

(Continued)

*Primary Examiner* — Jorge Pereiro
*Assistant Examiner* — Paul Thiede
(74) *Attorney, Agent, or Firm* — McCormick, Paulding & Huber LLP

(57) ABSTRACT

The invention concerns a vane cell machine with a stator and a rotor having radially displaceable vanes arranged in guides, said vanes bearing on an inside of the stator and bordering, together with the rotor, the stator and a side wall, work chambers at each axial end of the rotor. It is endeavored to provide a vane cell machine that has a good internal tightness, in which the wear is still kept small. For this purpose, in a radially internal area the side wall comprises an insert that is axially movable in the side wall and has a pressure application surface axially inside and axially outside.

15 Claims, 5 Drawing Sheets

(56) References Cited

U.S. PATENT DOCUMENTS

| | | | |
|---|---|---|---|
| 2001/0033803 | A1 | 10/2001 | Wong et al. |
| 2012/0222352 | A1 | 9/2012 | Janssen |
| 2013/0108499 | A1 | 5/2013 | Petersen et al. |

FOREIGN PATENT DOCUMENTS

| | | | |
|---|---|---|---|
| DE | 2422783 | A1 | 11/1975 |
| DE | 197 10 804 | A1 | 9/1998 |
| DE | 19710804 | A1 | 9/1998 |
| DE | 102010008062 | B3 | 6/2011 |
| EP | 0 247 001 | A2 | 11/1987 |
| EP | 0247001 | A2 | 11/1987 |
| EP | 0866224 | A1 | 9/1998 |
| EP | 2357362 | A2 | 8/2011 |
| WO | 8700587 | A1 | 1/1987 |
| WO | 01/59302 | A1 | 8/2001 |

* cited by examiner

VANE CELL MACHINE HAVING PLATES CONTAINING AXIAL MOVING INSERTS BEARING AGAINST THE ROTOR

CROSS REFERENCE TO RELATED APPLICATION

Applicants hereby claim foreign priority benefits under U.S.C. §119 from German Patent Application No. 10 2011 116 858.7 filed on Oct. 25, 2011, the contents of which are incorporated by reference herein.

TECHNICAL FIELD

The invention concerns a vane cell machine with a stator and a rotor having radially displaceable vanes arranged in guides, said vanes bearing on an inside of the stator and bordering, together with the rotor, the stator and a side wall, work chambers at each axial end of the rotor.

BACKGROUND

Such a vane cell machine is, for example, used as amplification pump before or after a pressure converter in a circuit of a reverse osmosis system. In a reverse osmosis system, water, for example saltwater, is pumped through a membrane and purified or desalinated water is then available on the outlet side of the membrane.

As, in such a machine, the rotor rotates in relation to the stator and a high pressure rules in the work chambers at least once during each rotation, it must be ensured that the vane cell machine is tight towards the inside and towards the outside. An internal leakage would reduce the efficiency. An external leakage is undesirable anyway.

Therefore, the rotor and the side wall must therefore bear on one another with a certain force, in order to keep internal leakages as small as possible. However, this force is not allowed to be too large, as the friction between the side wall and the rotor would thus cause a too large wear.

SUMMARY

The invention is based on the task of providing a vane cell machine with a good internal tightness and a small wear.

With a vane cell machine as mentioned in the introduction, this task is solved in that in a radially internal area the side wall comprises an insert that is axially movable in the side wall and has a pressure application surface axially inside and axially outside.

With this embodiment, the side wall is divided into two elements, namely the insert and an element surrounding the insert. The insert then forms some sort of piston in the side plate, said piston being displaceable in the direction of the rotor or in the opposite direction. In this connection, the displacement forces adhere to the pressures acting upon the two pressure application surfaces axially inside and axially outside. When the pressure application surfaces and the pressures acting upon them are adapted to each other accordingly, a hydraulic balance can be achieved, so that the insert and the rotor bear on each other with a force that is chosen so that on the one hand a satisfactory tightness is achieved and on the other hand the wear can be kept small.

Preferably, the side wall is made as a plate. A plate is relatively easily manufactured. When the insert is inserted in the plate, the assembled plate can be assembled with the stator as a separate element. With regard to function, the plate with the insert then forms a part of the stator.

Alternatively, the side wall can be formed in a housing of the vane cell machine. In this case, no additional element is required apart from the insert, which also has a positive effect on the accuracy during mounting. The smaller the number of parts to be mounted, the smaller the errors that can occur because of tolerances.

Preferably, a sealing ring is arranged between the stator and the insert. This sealing ring, for example an O-ring, seals the insert towards the outside. This sealing ring can be arranged in a groove, in order to define its position clearly. The sealing ring is arranged at a position, where adjacent parts are not moving in relation to each other. Thus, the sealing ring provides a simple way of preventing large amounts of fluid from escaping from the stator to the outside.

Preferably, the sealing ring is arranged at a radial position of the rotor, at which the forces caused by the pressure of the fluid radially outside the sealing ring are as large as forces caused by the pressure of the fluid on the side of the insert facing the rotor. The forces do not have to be exactly equal. The force acting radially inwards can be somewhat larger than the force acting radially outwards. The sealing ring seals radially inwards. Radially outside the sealing ring, fluid is available between the stator and the insert. On the opposite side of the insert the fluid can penetrate further radially inwards through a gap between the rotor and the insert. In this gap, however, the pressure of the fluid subsides radially from the outside towards the inside. Now, the position of the sealing ring can be determined so that the pressure application surface on the insert is smaller on the axial outside than on the axial inside. In this connection, the pressure application surfaces extend in the radial direction and are exposed to a pressure that acts in the axial direction. The relation between the sizes of the pressure application surfaces is then chosen so that the pressure subsiding in the radial direction acts upon a correspondingly larger pressure application surface on the axial inside of the insert. Simply expressed, when regarding an axial section, the integral of the pressure across the surface on the axial outside of the insert is approximately as large as the pressure integral across the pressure application surface on the axial inside of the insert.

Preferably, the insert comprises an axial extension that forms a bearing for a shaft that is connected to the rotor. Thus, it is possible to form the insert so that at the same time it forms the bearing for the shaft of the rotor. The shaft sealing can then be arranged between shaft of the rotor and the insert. In this case, the pressure can act axially inside upon the complete axial extension of the insert.

Preferably, the extension comprises a step that forms a bearing surface for the sealing ring. At the same time, the step then defines the radial position of the sealing ring.

Preferably, the insert is arranged in a central recess of the side wall and comprises an eccentric bore, through which the rotor is led. When the rotor is provided with a shaft, this shaft is of course led through this eccentric bore of the insert. In a vane cell machine with one work stroke of the vane per rotation of the rotor, the inside of the stator, on which the vanes rest, can have the shape of a hollow cylinder. In order still to realize the radial extension and retraction movement of the vanes, the rotor is eccentrically supported, that is, one point on the circumference of the rotor approaches the inside of the stator and moves away from the inside of the stator again during each rotation. This eccentricity is easily realized by means of the insert. This embodiment has the further advantage that it is easily ensured that the vanes can always rest with their front sides on the element surrounding the insert. Accordingly, the vanes and this element can be adapted to each other with regard to material in such a manner that the wear remains as small as possible.

BRIEF DESCRIPTION OF THE DRAWINGS

In the following, the invention is described on the basis of preferred embodiments in connection with the drawings, showing.

DETAILED DESCRIPTION

Figure 2:
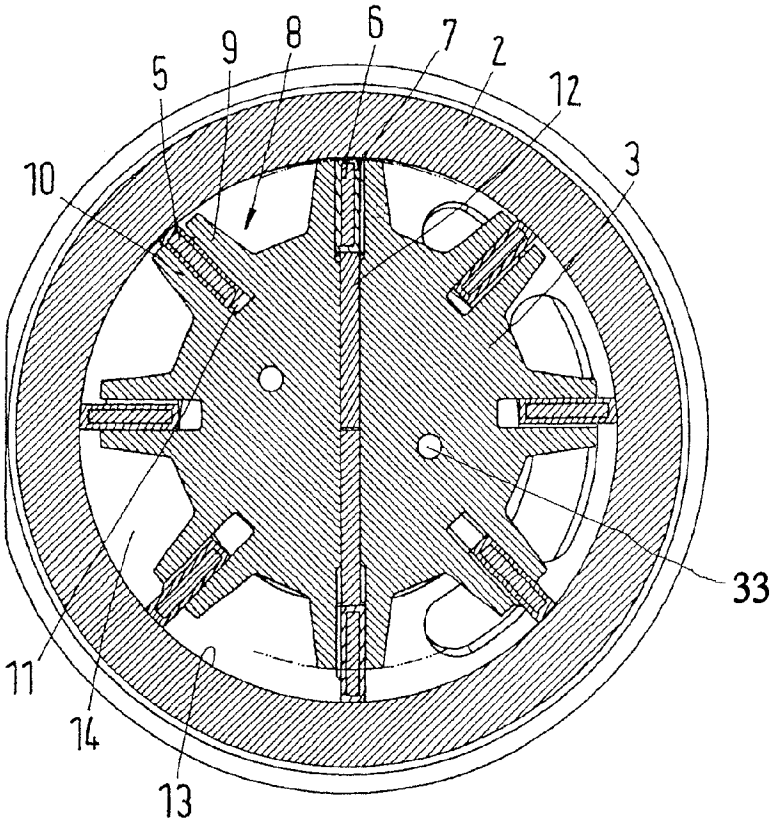
FIG. 2 is a section II-II according to FIG. 1.

A vane cell machine 1 comprises a stator 2 in which a rotor 3 is rotatably supported. The rotor is connected to a shaft 4 that is, when the vane cell machine 1 is made as a pump, connected to a drive motor that is not shown in detail. When the vane cell machine 1 works as a motor, an output can be taken at the shaft 4.

The rotor 3 is made of a first material, preferably steel. In the rotor 3 several vanes 5 are distributed in the circumferential direction, each vane comprising a core 6 of steel that is surrounded by an enclosure 7 that is made of a second material that differs from the first material, preferably a plastic material that interacts unfrictionally with the steel of the rotor 3. The stator 2 is also made of the first material, preferably steel. The enclosure 7 also interacts unfrictionally with the material of the stator 2, also when the vane cell machine 1 is operated with water.

In the following description, steel is used as the first material and a plastic material that interacts unfrictionally with steel is used as the second material.

The material for the enclosure 7 can be selected from the group of high-resistant thermo-plastic plastic materials on the basis of polyaryletherketones, in particular polyetheretherketones, polyamides, polyacetals, polyarylethers, polyethyleneterephtalates, polyphenylensulfides, polysulphones, polyethersulphones, polyetherimides, polyamidimides, polyacrylates, phenol-resins, such as novolacquer-resins, and glass, graphite, polytetraflourethylene or carbon, particularly as fibres, can be used as filler.

For each vane, the rotor 3 has a guide 8. Each guide 8 has two substantially radially progressing and axially extending walls 9, 10, between which the vane 5 is guided in the radial direction (in relation to the rotation axis of the rotor). On the radial inside of the vane 5 a chamber 11 is arranged in the guide, fluid getting into said chamber through a gap between the vane 5 and the walls 9, 10.

As can be seen from FIG. 2, the rotor 3 has an even number of vanes 5. Between any two diametrically opposed vanes 5, a rod 12 is positioned. This rod 12 is also made of the friction-reducing plastic material. The rod 12 is dimensioned so that the diametrically opposed vanes 5 bear on the inside 13 of the rotor 3. A small tolerance is permissible in order to avoid jamming.

Any two vanes 5 being adjacent to each other in the circumferential direction border a chamber 14. As can be seen from FIG. 2, the volume of the chamber 14 changes during a rotation of the rotor inside the stator 2, as known from vane cell machines.

The chambers 14 must be tightened at their axial front sides. For this purpose, a side wall 15 is formed at each front side of the vanes 5. In the present case, the side wall 15 is formed at a plate 16. The plate 16 is made of steel, so that the vane 5 with its enclosure 7 can rub along the plate 16. Because of the plastic material of the enclosure 7, a movement with a relatively low friction occurs here.

An insert 17 is inserted in the plate 16. At least on its surface, the insert is made of a third material that can be equal to the second material. Thus, here the surface of the insert 17 is also made of the friction-reducing plastic material. The insert 17 bears on a front side section 18 of the rotor 3.

The insert 17 is inserted in a central bore 19 of the plate 16. The insert 17 comprises an eccentric bore 20, through which the rotor 3 is led. Accordingly, it is possible to dimension the plate 16 with the insert 17 so that during the complete rotation the vanes 5 with their enclosure 7 only bear on the plate 16, that is, on steel, whereas the rotor 3 with its front side section 18 only bears on the insert 17, that is, on plastic material. Merely in the area of the radial inner end of the vanes 5 a slight overlapping between vanes 5 and insert 17 can occur, which is, however, uncritical because it is so small.

With this embodiment it can be ensured that friction always only occurs between parts, of which one has a surface of steel and the other has a surface of the friction-reducing plastic material, for example polyether ether ketone ("PEEK").

It is possible that fluid under pressure can penetrate axially to the outside between the plate 16 and the insert 17. Accordingly, an O-ring 22 (or a similar sealing) is arranged between the insert 17 and a front-side housing part 21. This O-ring 22 can have an axial and/or radial pretension, so that it already tightens during small pressures, for example to avoid a leakage during start-up.

The position of the O-ring will be explained in the following.

The rotor 3 has several axially extending through channels 33, which ensure a pressure balance between the axial rotor ends.

The insert 17 is movable in the axial direction in relation to the plate 16, that is, forms some sort of "piston". The division into insert 17 and plate 16 also simplifies the manufacturing. Thus, the plate 16 and the insert 17 can be made with plane parallel surfaces. The insert 17 can be slightly thicker than the plate 16.

Figure 3:
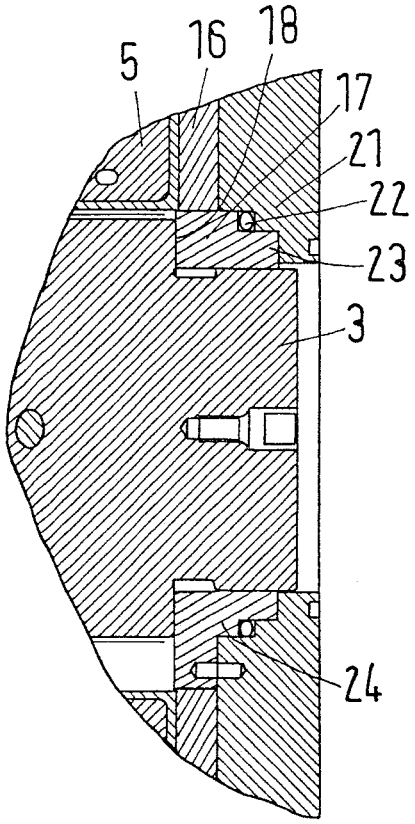
FIG. 3 is a partial section through a modified embodiment of a vane cell machine.
Figure 4C:
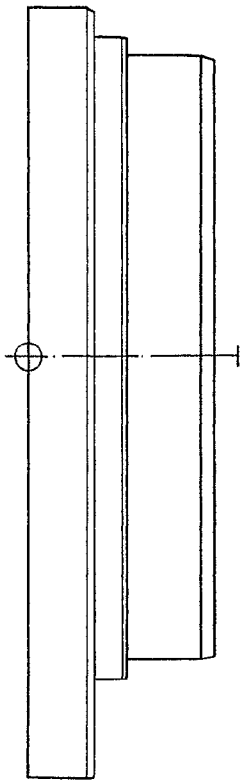
FIGS. 4*a*, 4*b*, and 4*c* are enlarged views of an insert according to FIG. 3.
Figure 4B:
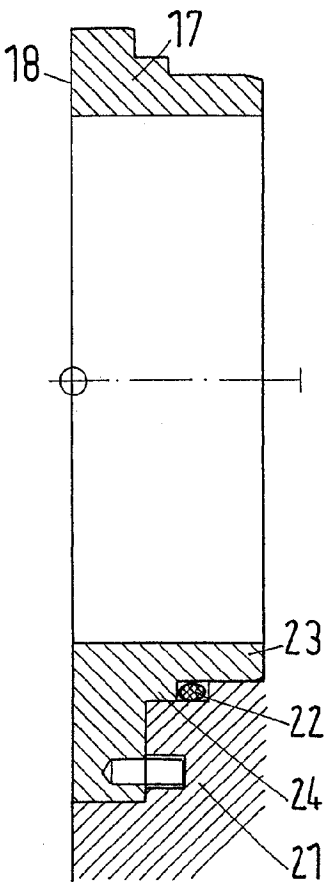
Figure 4A:
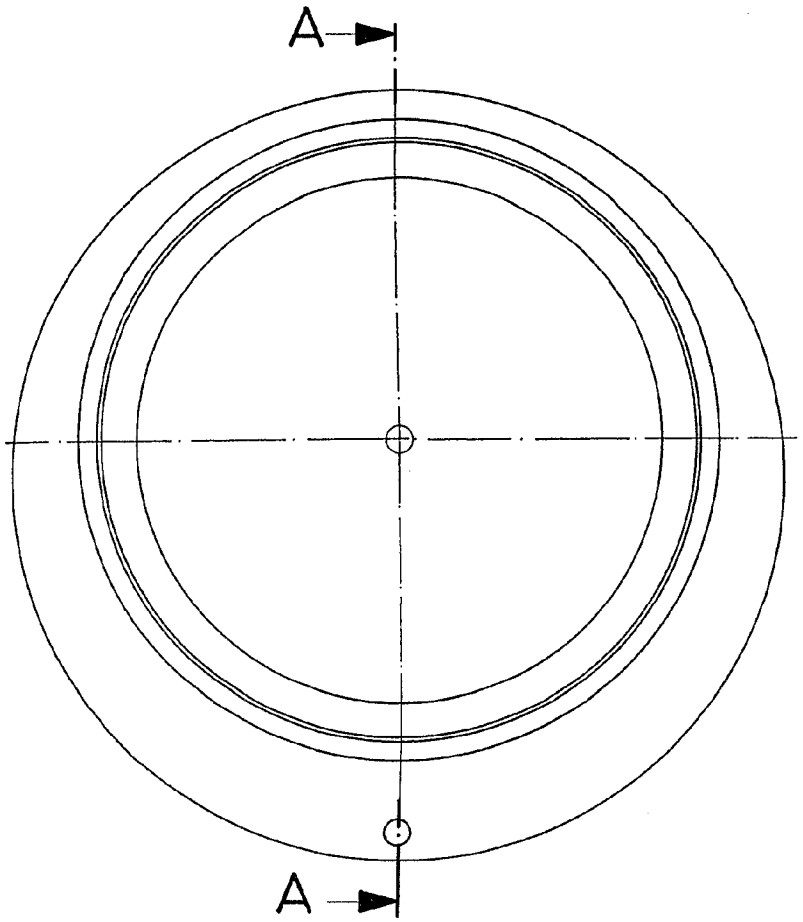

FIG. 3 shows a slightly modified embodiment, in which the same elements have the same reference numbers. FIG. 4 shows the insert 17 alone, namely in FIG. 4*a* a front view, FIG. 4*b* a section A-A according to FIG. 4*a* and FIG. 4*c* a side view.

The insert 17 is now extended in the axial direction and forms a bearing 23 for the rotor 3. Accordingly, also the material pair between the rotor 3 (steel) and the bearing 23 on its circumferential surface (PEEK) is made so that here an unfrictional behavior occurs.

Figure 5:
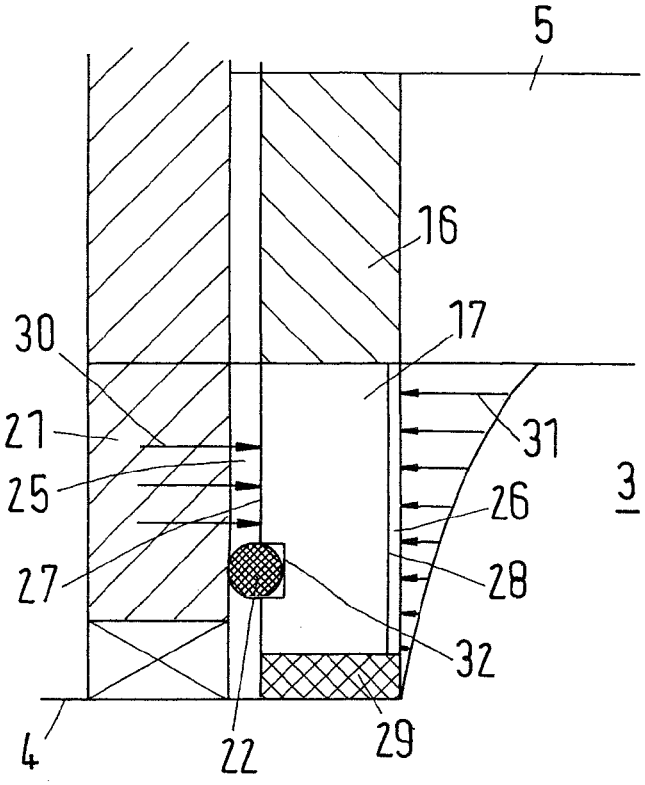
FIG. 5 is a schematic view explaining a distribution of pressures on the insert.

The position of the O-ring is explained by means of FIG. 5. The same and functionally equal elements have the same reference numbers as in the FIGS. 1 to 4.

The rotor 3 is here made in one piece with the shaft 4. However, the shaft 4 can also be made as a separate part.

Between the insert 17 and the housing part 21 a gap 25 is formed. Further, a gap 26 is provided between the rotor 3 and the insert 17. The gap 25 can be slightly larger than the gap 26.

In the gap 25 an O-ring 22 is arranged, so that it is ensured that in the pressure-less state the gap 25 can always be kept open.

In the gap 25 the insert 17 has a first pressure application surface 27. In the gap 26 the insert has a second pressure application surface 28. The first pressure application surface 27 is bordered on the radial inside by the O-ring 22. Basically, the second pressure application surface 28 is bordered by the shaft 4 or a shaft sealing 29 sealing the shaft 4. From this it can be seen that the second pressure application surface 28 is larger than the first pressure application surface 27. The relation between the pressure application surfaces 27, 28 can be determined by the position of the O-ring 22.

In the gap 25 between the housing part 21 and the insert 17 a high pressure rules that is symbolized by arrows 30. This pressure is constant in the radial direction, which is symbolized by the fact that all arrows 30 have the same length.

Also in the gap 26 a high pressure rules, which is symbolized by arrows 31. As a small flow is permitted between the rotor and the insert 17, the pressure subsides from the radial outside towards the radial inside. This is symbolized by the fact that radially inwards the arrows have a subsiding length.

The two pressure application surfaces 27, 28 are now dimensioned so that the product of the first pressure application surface 27 and the constant pressure (arrow 30) approximately equal to the product of the second pressure application surface 28 and the subsiding pressure in the gap 26. With this dimensioning it can be achieved that a hydraulic balance occurs across the insert 17. As the insert is movable in the axial direction in the plate 16, the position of the insert 17 in relation to the rotor can be adjusted so that a maximum tightness is achieved, yet at the same time the wear is kept small. The movements of the insert 17 in relation to the side plate 16 are, however, very small.

The insert 17 and the plate 16 are made as two separate parts, so that the side plate made of the plate 16 and the insert 17 can be made with plane parallel surfaces.

Figure 6:
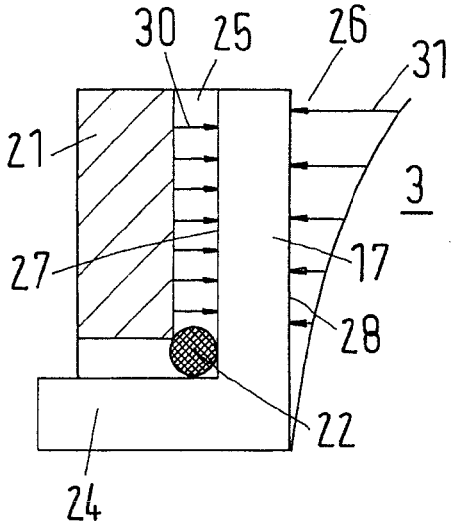
FIG. 6 is a simplified view according to FIG. 5 for a different embodiment.

FIG. 6 shows a corresponding embodiment of the insert 17 with step 24. Also here a gap 25 exists between the housing part 21 and the insert 17 and a gap 26 exists between the insert 17 and the rotor 3. The first pressure application surface 27 is smaller than the second pressure application surface 28, as the first pressure application surface 27 is bordered radially towards the inside by the O-ring 22. The step 24 defines the position of the O-ring 22. In the embodiment according to FIG. 5 a groove 32 takes over the positioning.

Again, the arrows 30, 31 symbolize that the pressure in the gap 25 that acts upon the first pressure application surface 27 is constant in the radial direction, whereas the pressure in the gap 26 that acts upon the pressure application surface 28 subsides from the radial outside towards the radial inside.

Figure 1:
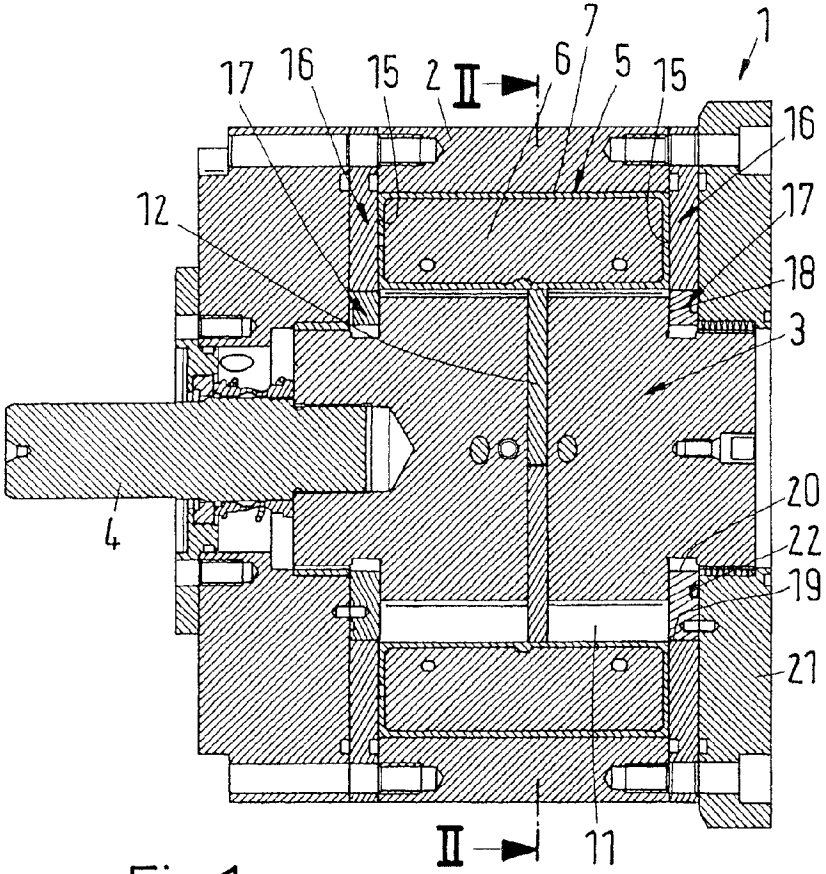
FIG. 1 is a schematic longitudinal section through a vane cell machine.
Figure 7:
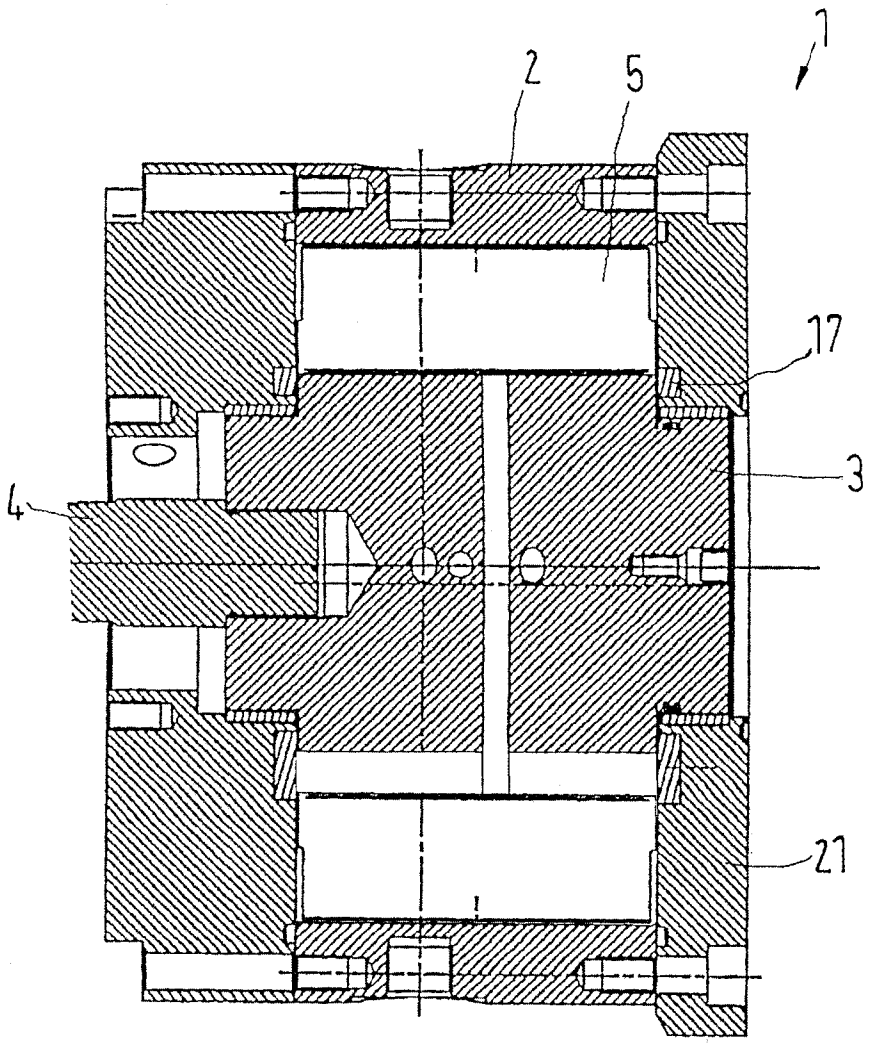
FIG. 7 shows an embodiment modified in relation to FIG. 1.

FIG. 7 shows a schematic view of an embodiment that is modified in relation to FIG. 1. The same and functionally equal parts have the same reference numbers.

In this embodiment, the insert 17 is arranged immediately in the front-side housing part 21, that is, on the radial outside of the insert 17 the front-side housing part 21 also takes over the function of the plate 16.

In this embodiment, the O-ring 21 between the insert 17 and the front-side housing part is not absolutely necessary. Accordingly, for reasons of clarity, this O-ring is not shown in FIG. 7. Of course, it can still be there. This O-ring can then act as "spring" for the generation of an initial force on the insert 17 during start-up, so that already during start-up the insert 17 is pressed against a corresponding surface of the rotor 3.

However, this force can also be generated in a different manner, for example by means of a spring between the insert 17 and the front-side housing part 21.

While the present invention has been illustrated and described with respect to a particular embodiment thereof, it should be appreciated by those of ordinary skill in the art that various modifications to this invention may be made without departing from the spirit and scope of the present.

What is claimed is:

1. A vane cell machine comprising:

a hollow stator, a rotor disposed within the hollow stator, radially displaceable vanes arranged in guides at a radially outward surface of said rotor, two side walls, each side wall at an axial end of the rotor and including a plate that has a central bore that is substantially coextensive with a side section of the rotor, and two inserts, each insert fitted into the central bore of a corresponding one of the two side walls and each insert defining a bore that is eccentric to the central bore of the corresponding side wall, the bores of the two inserts being coaxial with the rotor, wherein said rotor at its axial sides bears substantially only against the inserts, wherein said vanes bear at their radially outward edges on an inside of the stator and bear at their axial sides substantially only against the plates, wherein said vanes, together with the rotor, the stator and the two side walls at each axial end of the rotor, border work chambers, wherein each insert is axially movable in relation to the rest of the corresponding side wall plate, and wherein each insert has a first pressure application surface on an axial inside surface facing the work chambers and the rotor and a second pressure application surface on an axial outside surface facing away from the work chambers.

2. The vane cell machine according to claim 1, wherein at least a portion of each side wall is disposed adjacent to a surface of the stator of the vane cell machine.

3. The vane cell machine according to claim 2, wherein a sealing ring is arranged between a front-side housing part of the stator and the insert.

4. The vane cell machine according to claim 2, wherein the insert comprises an axial extension that forms a bearing for a shaft that is connected to the rotor.

5. The vane cell machine according to claim 2, wherein a portion of the rotor extends through the eccentric bore.

6. The vane cell machine according to claim 1, wherein a sealing ring is arranged between a front-side housing part of the stator and the insert.

7. The vane cell machine according to claim 6, wherein the sealing ring is arranged at a radial position along the second pressure application surface at which the forces on the second pressure application surface caused by the pressure of the fluid radially outside the sealing ring are as large as forces on the first pressure application surface caused by the pressure of the fluid on the side of the insert facing the rotor.

8. The vane cell machine according to claim 7, wherein the insert comprises an axial extension that forms a bearing for a shaft that is connected to the rotor.

9. The vane cell machine according to claim 2, wherein a portion of the rotor extends through the eccentric bore.

10. The vane cell machine according to claim 6, wherein the insert comprises an axial extension that forms a bearing for a shaft that is connected to the rotor.

11. The vane cell machine according to claim 2, wherein a portion of the rotor extends through the eccentric bore.

12. The vane cell machine according to claim 1, wherein the insert comprises an axial extension that forms a bearing for a shaft that is connected to the rotor.

13. The vane cell machine according to claim 12, wherein the extension comprises a step that forms a bearing surface for the sealing ring.

14. The vane cell machine according to claim 2, wherein a portion of the rotor extends through the eccentric bore.

15. The vane cell machine according to claim 1, wherein a portion of the rotor extends through the eccentric bore.

* * * * *